US010024071B2

(12) United States Patent
Cockerell

(10) Patent No.: US 10,024,071 B2
(45) Date of Patent: Jul. 17, 2018

(54) SAFETY AND DEBRIS DROP NETTING SYSTEM AND RELATED METHODOLOGY

(71) Applicant: Safety Guys, LLC, Dania Beach, FL (US)

(72) Inventor: Chris Cockerell, Hollywood, FL (US)

(73) Assignee: SAFETY GUYS, LLC, Dania Beach, FL (US)

( * ) Notice: Subject to any disclaimer, the term of this patent is extended or adjusted under 35 U.S.C. 154(b) by 0 days.

(21) Appl. No.: 15/234,881

(22) Filed: Aug. 11, 2016

(65) Prior Publication Data

US 2018/0044931 A1 Feb. 15, 2018

(51) Int. Cl.
*E04G 21/30* (2006.01)
*E04G 21/32* (2006.01)

(52) U.S. Cl.
CPC ..... *E04G 21/3266* (2013.01); *E04G 21/30* (2013.01); *E04G 21/32* (2013.01); *E04G 21/3261* (2013.01)

(58) Field of Classification Search
CPC ..... E04G 21/3266; E04G 21/3261
See application file for complete search history.

(56) References Cited

U.S. PATENT DOCUMENTS 3,949,834 A * 4/1976 Nusbaum ..... E04G 21/3261 182/138
4,074,791 A 2/1978 Inman
4,129,197 A * 12/1978 Preston ..... E04G 21/3223 182/112
4,838,382 A 6/1989 Nusbaum
4,856,615 A 8/1989 Nusbaum
4,875,549 A * 10/1989 Denny ..... E04G 21/28 182/138
4,892,169 A 1/1990 Duncan
4,944,365 A 7/1990 Shalders
4,962,828 A 10/1990 Duncan
5,161,641 A 11/1992 Nusbaum
5,299,654 A 4/1994 Duncan
5,429,206 A 7/1995 Nusbaum
7,228,938 B1 * 6/2007 Mitchell ..... E04G 3/22 182/113
7,258,198 B2 8/2007 Rexroad
7,322,553 B2 * 1/2008 Rexroad ..... E04G 21/3261 182/138

(Continued)

*Primary Examiner* — Alvin C Chin-Shue
(74) *Attorney, Agent, or Firm* — Lewis Brisbois Bisgaard & Smith LLP; Geoffrey Lottenberg, Esq.

(57) ABSTRACT

A drop netting system configured to installation on a building slab such as a balcony to protect against falling debris, overspray, concrete, and the like. The system includes plurality of spaced apart brackets disposed around the perimeter of the slab so as to form an array of attachment points for a drop net to be attached to and suspended from the brackets. The brackets extend outward from the edge of the slab and are each optionally angled slightly upward from the surface of the slab. A drop net is secured to the distal end of each bracket and suspended therefrom such that the drop net is spaced away from the edge of the slab to permit construction workers to have access of the slab edge in order to carry out construction work. The drop netting system can be installed on adjacent floors to encase the space between the floors.

10 Claims, 6 Drawing Sheets

(56) References Cited

U.S. PATENT DOCUMENTS

| | | | | |
|---|---|---|---|---|
| 7,389,855 | B2 * | 6/2008 | Rexroad | E04G 21/3261 182/137 |
| 7,389,955 | B2 | 6/2008 | Rexroad | |
| 8,511,039 | B2 * | 8/2013 | Dougall | E04G 21/3219 182/113 |
| 2006/0090961 | A1 * | 5/2006 | Rexroad | A62B 1/22 182/138 |
| 2006/0151243 | A1 | 7/2006 | Rexroad | |
| 2006/0237607 | A1 * | 10/2006 | Rexroad | G09F 19/22 248/228.1 |
| 2007/0102241 | A1 * | 5/2007 | Rexroad | E04G 21/3261 182/138 |
| 2016/0017618 | A1 * | 1/2016 | White | F16M 13/022 182/138 |

* cited by examiner

SAFETY AND DEBRIS DROP NETTING SYSTEM AND RELATED METHODOLOGY

FIELD OF THE INVENTION

This application generally relates to safety and debris netting for multi-floor construction and more particularly to a drop netting system for multi-floor or other types of construction and related methodology.

BRIEF DESCRIPTION OF THE DRAWINGS

The drawings appended hereto are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION

Figure 1:
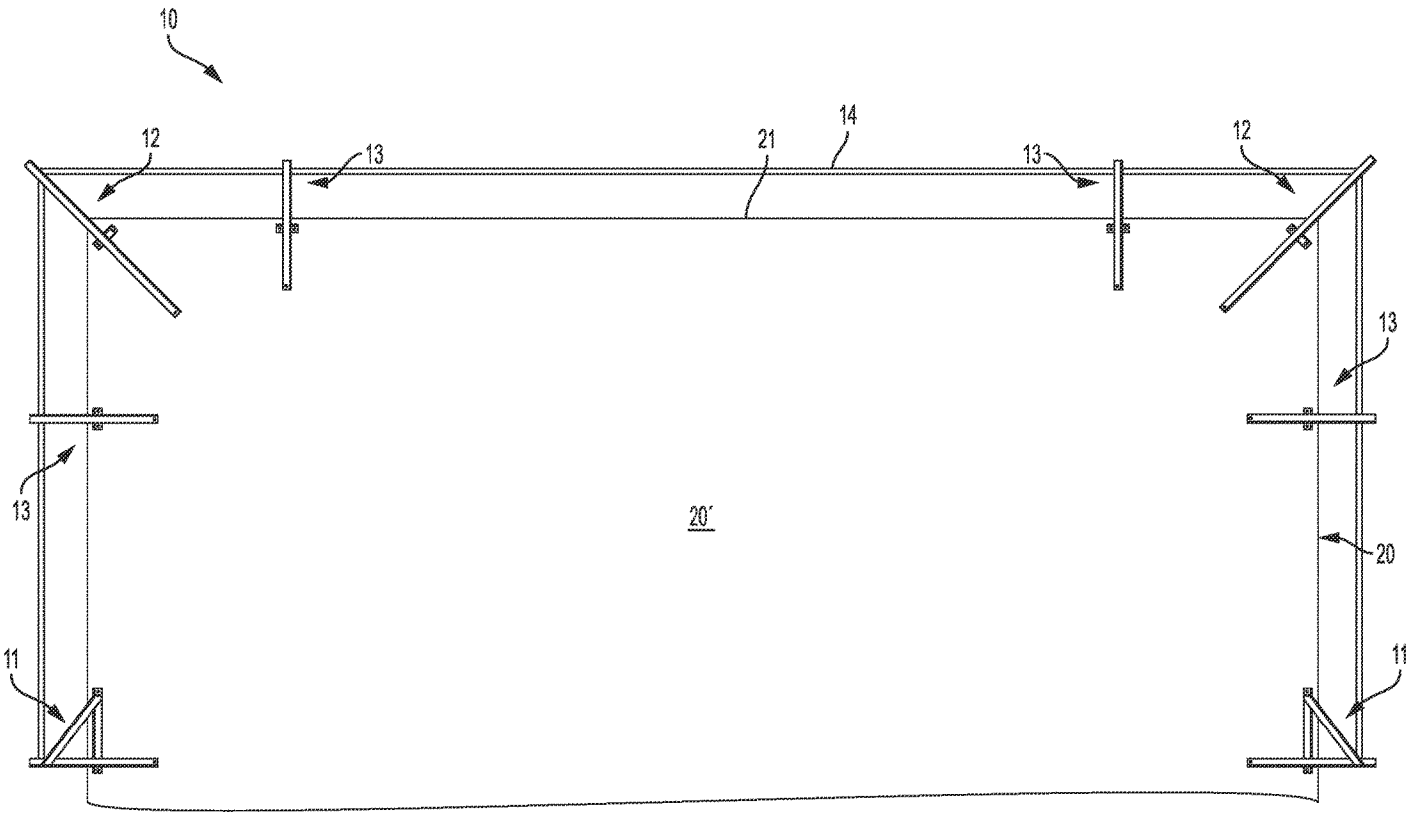
FIG. 1 is a top view schematic of one embodiment of the drop netting system.

For the purposes of promoting an understanding of the principles of this disclosure, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc. Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional un-recited elements or method steps. "Comprising" is to be interpreted as including the more restrictive terms "consisting of" and "consisting essentially of."

With reference to FIG. 1 shown is a schematic of one embodiment of the drop netting system 10 installed on an exemplary slab 20. In some embodiments, the slab 20 is a balcony or other structure of a building on and around which it is desired to have protection against falling debris, overspray, concrete, and the like. The system 10 comprises array or a plurality of spaced apart brackets disposed around the perimeter of the slab 20 so as to form an array of attachment points for a drop net to be attached to and suspended from the brackets. The brackets are attached to the top surface 20' of the slab 20 and are clear from and extend outward from the edge 21 of the slab 20. Optionally, each bracket is angled slightly upward from the surface of the slab 20 so as to provide further clearance of the brackets from the area surrounding the edge 21 of the slab 20. A drop net is secured to the distal end of each bracket and suspended therefrom such that the drop net is spaced away from the edge 21 of the slab 20 in such a manner to permit construction workers to have access of the slab 20 and the edge 21 in order to carry out construction work.

In some embodiments, at least two terminal brackets 11 are provided, in the depicted non-limiting embodiment a first terminal bracket at the left rear corner of the slab 20 and a second terminal bracket at the right rear corner of the slab 20. At least two corner brackets are provided at the opposing outward facing corners of the slab 20. A plurality of add-on brackets 13 may also be optionally provided. In some embodiments, at least one add-on bracket is positioned on the slab 20 between the terminal brackets 11 and the corner brackets 12 and between the two corner brackets 12. In some embodiments, depending on the relative dimensions of the slab 20, two or more add-on brackets 13 may be positioned between the two corner brackets 12, or the terminal brackets 11 and corner brackets 12. In some embodiments, the corner brackets 12 are configured and installed such that they extend away from the edge 21 of the slab 20 further than that of the add-on brackets 13 or terminal brackets 11.

Figure 2A:
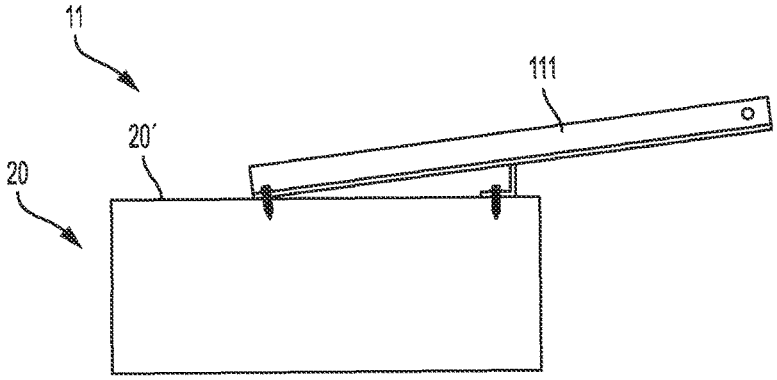
FIG. 2A is a side view of the left and right terminal brackets.
Figure 2B:
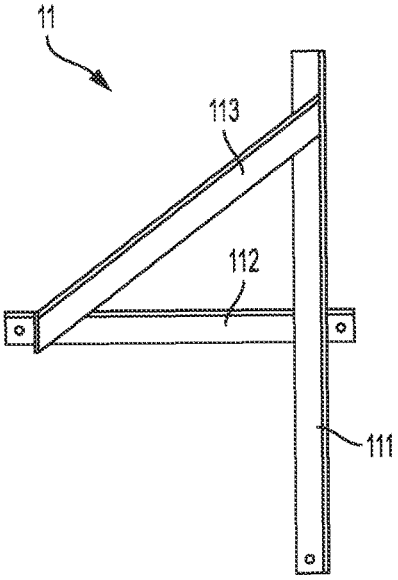
FIG. 2B is a top view of the left and right terminal brackets.

FIGS. 2A-4B depict the configurations of the various brackets employed by the system. FIGS. 2A and 2B show the terminal brackets 11 in top and side views. The terminal brackets 11 included a support beam 111, a cross beam 112, and a stabilizing beam 113. The cross beam is a perpendicular to the support beam 111 with support beam 111 attached approximately at a first end of the cross beam 112. The stabilizing beam 113 is attached at the other end of the cross beam 112 and extends diagonally toward and is attached to the support beam 111. The cross beam 112 is configured to be secured to the slab 20 with the distal end of support beam 111 configured to extend past the edge 21 of the slab 20. In some embodiments, the proximal end of the support beam 111 is also secured to the slab 20. The cross beam 112, in some embodiments, is configured as an L-bracket that is positioned such that the support beam 111 is elevated at an angle relative to the slab 20.

Figure 3A:
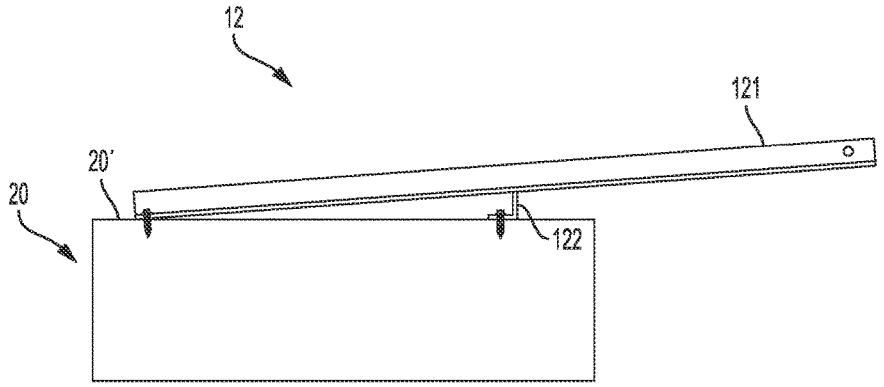
FIG. 3A is a side view of the corner bracket.
Figure 3B:
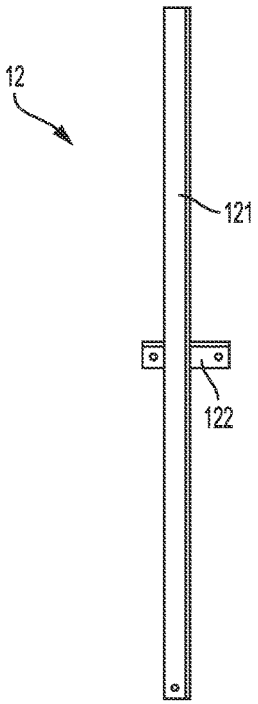
FIG. 3B is a top view of the corner bracket.
Figure 4A:
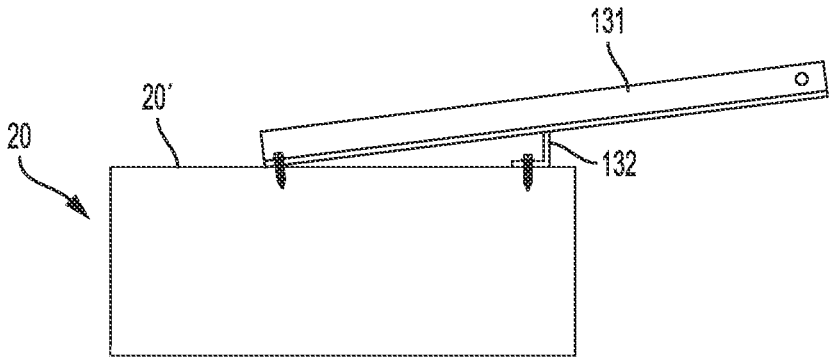
FIG. 4A is a side view of the add-on bracket.
Figure 4B:
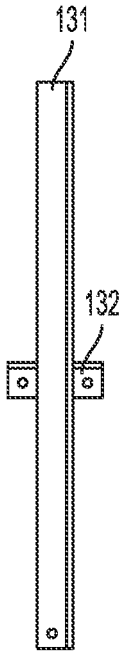
FIG. 4B is a top view of the add-on bracket.

Shown in FIGS. 3A-3B is corner bracket 12, which comprises an elongated support beam 121 secured to the slab 20 at a proximal end and, optionally, by way of L-bracket 122. The L-bracket 122 may be welded to the beam 121 at a location approximately at the center of the length thereof. The L-bracket 122 secures and elevates the elongated support beam 121 at an angle relative to the slab 20. Shown in FIGS. 4A-4B is add-on bracket 13, which comprises an elongated support beam 131 secured to the slab 20 at a proximal end and, optionally, by way of L-bracket 132. The L-bracket 132 may be welded to the beam 131 at a location approximately at the center of the length thereof. The L-bracket 132 secures and elevates the elongated support beam 131 at an angle relative to the slab 20.

Figure 5:
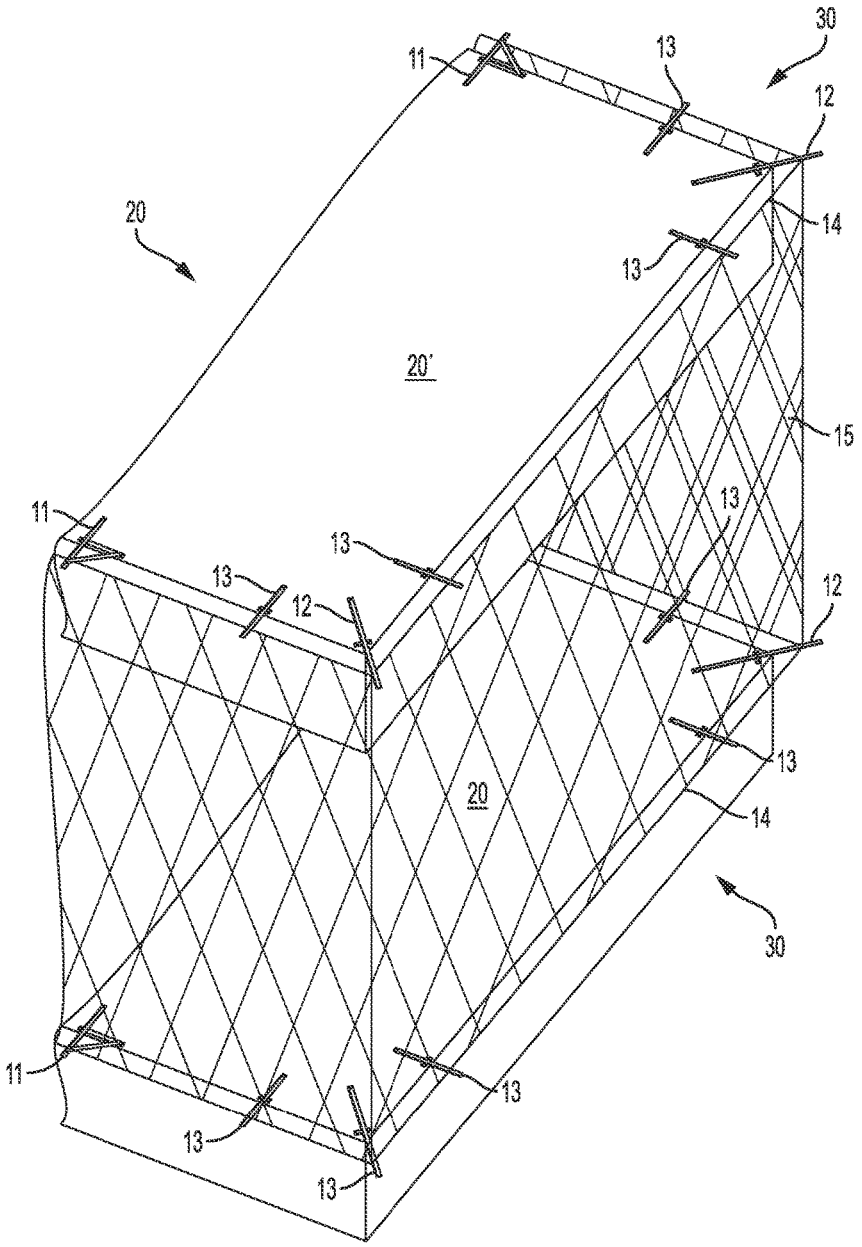
FIG. 5 is a perspective view of one embodiment of the drop netting system deployed at the side a building.

FIG. 5 depicts and embodiment of the system 10 installed across two slabs 20 which represent slabs or balconies on adjacent floors of a building, an upper floor 30 and a lower floor 30'. Each slab 20 includes a system 10 including first and second terminal brackets 11, a corner bracket 12 at each outward corner, and at least one add-on bracket 13 disposed between each terminal bracket 11 and corner bracket 12 and the two corner brackets 12. A cable 14 is traced around and attached cohesively across the distal ends of each of the brackets on the respective slabs 20. A net 15 is then attached at to the cable 14 at the upper floor 30 and to the cable 14 at the lower floor 30' thereby suspending the net between the floors and encasing the slabs 20 and the space between the floors so as to prevent the spread of debris from work areas at or about the slabs 20. In some embodiments, because the brackets extend outward and away from the edge 21 of the slabs 20, the net 15 is spaced apart from the edge 21 thereby providing access space for construction workers.

The spaced-apart configuration of the net is particularly useful for stucco, concrete, paint and masonry workers that need access to the edge and bottom of a slab 20 and will be using construction materials that are prone to creating debris and loss of building material. They system 10 herein permits the worker to work right up to the edge of the slab 20 but be in close proximity to the net 30, which can quickly and easily contain debris and excess building material. In some embodiments, the corner bracket 12 extends away from the edge 21 of the slab 20 further than the terminal and add-on brackets, thereby creating a great access space at the corner of the slab 20, where more space is often needed for more intricate work.

Figure 6:
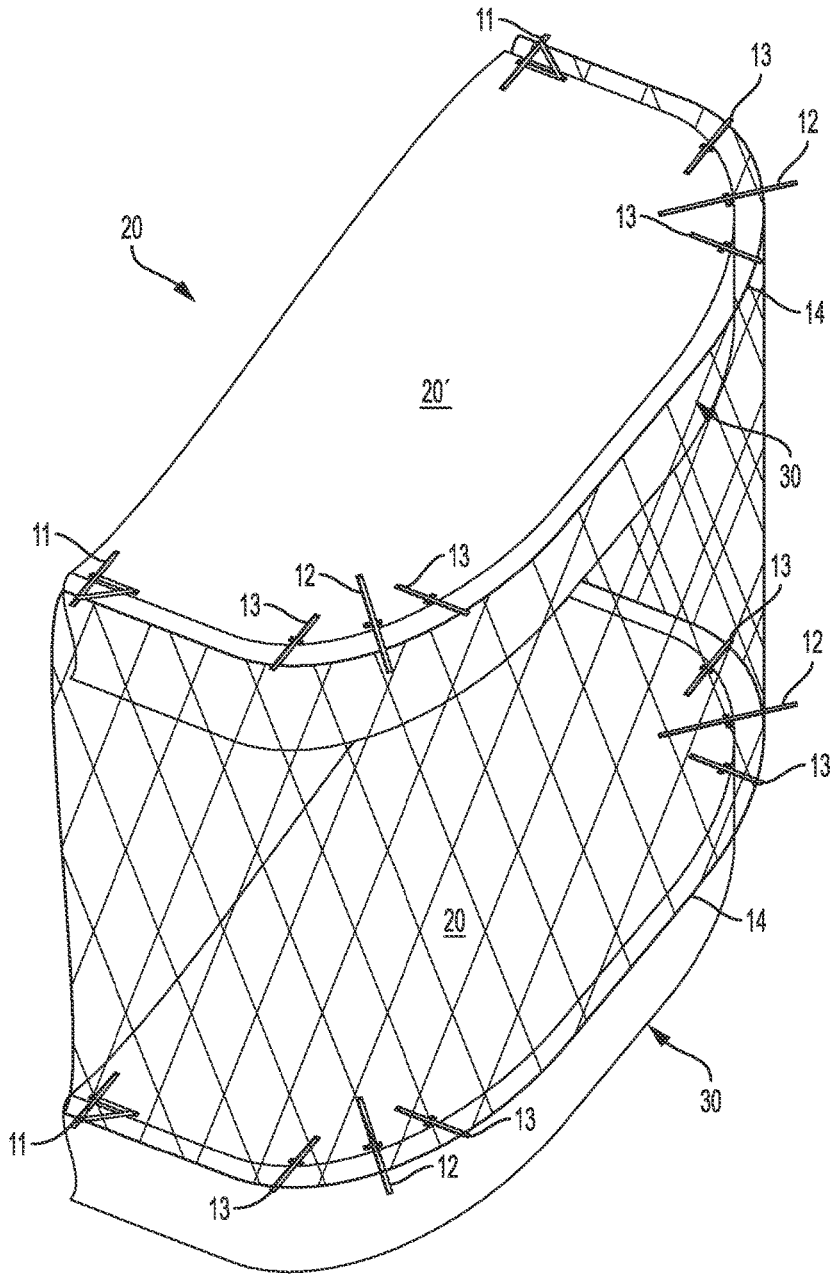
FIG. 6 is a perspective view of another embodiment of the drop netting system.

FIG. 6 depicts another non-limiting embodiment of the system 10, this configuration ideal for curved or irregular, non-rectangular, shaped slabs 20. In this case, a semi-circular slab configuration is shown with the system 10 installed on an upper floor 30 and a lower floor 30'. The system 10 includes first and second terminal brackets 11 at the edges, with a plurality of add-on brackets 13 disposed around the perimeter of the slab 20 between the first and second terminal brackets. In this embodiments, because of the curved nature of the slab 20 it may not necessary to employ a longer corner bracket 12 at any given position. In this configuration, the cable 14 is attached to the brackets and the net 15 is attached and suspended there to and will result in the net encasing the slabs and the space between floors to prevent the spread of debris and construction material.

It is appreciated and understood that the various brackets may comprise materials of varying material and cross-section. For example, wood, steel, aluminum, and combinations thereof may be employed. Cross-sections may vary as the bracket beams may be tubular, square, or L-shaped. The means and manner by which the brackets are secured to the slab 20 is not limiting although in some embodiments concrete screws or like fasteners can be used. Other hardware may be utilized to reinforce the attachment points on the slab. The net 15 can vary in type, thickness and designed although it may desirable to employ a net 15 with a fine mesh backing or fine mesh array in order to retain and prevent the dispersion of debris, especially that occurring during stucco, tile, and concrete application. The means of attaching the net to the distal ends of the brackets can vary but may include hooks, clips, eyelets, and other like fastening or securing means.

By way of non-limiting example, it is helpful to describe certain relative dimensions of system components. In some embodiments, it is desirable for each of the brackets 11, 12, and 13 to extend away from the edge 21 of the slab 20 by at least 12 inches to provide optimal clearance for construction. In some embodiments, the corner brackets extend from the edge 21 further than the other brackets; for example, the corner brackets may extend from the edge 21 by 18 inches whereas the terminal 11 and add-on 13 brackets extend only 12 inches. The spacing of the brackets may also vary although in one embodiment it is desirable that the brackets are spaced apart no greater than 15 feet in order for the net 15 to remain taut and secure. In some embodiments, the various brackets extend away from the edge the same distance as they extend toward the slab, i.e. a 36 inch corner bracket extends 18 inches away from the edge.

The system 10 of the present invention is designed to be installed on adjacent floors although it may be possible to install on every other floor or other desired spacing in order to cover more than one floor or story of a building. Moreover, the system can adapted to be installed on successive adjacent floors with multiple nets attached to the brackets 11, 12, and 13, in succession on each such floors in order to construct a netting system which covers the entire side or a large portion of a building. The netting system is also designed to be modular in order to permit its usage in a variety of applications and with various sized, shaped, and configured building structures. The system 10 may can be employed in a variety of building applications including high rise construction, low rise construction, bridge construction, and the like.

While specific embodiments have been described in detail, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A netting system for construction, comprising:

a first array of a plurality of spaced brackets, each of said brackets being rigid and comprising:

a beam having a proximal end adapted to be secured to a top surface of a slab, and a distal end having an aperture, an L-bracket having a proximal end adapted to be secured to the top surface of the slab, and a distal end interconnected to said beam between said proximal end and said distal end of said beam, wherein when said beam and said L-bracket are secured to the top surface of the slab, said distal end of said beam is positioned away from an edge of the slab, such that the edge is accessible to permit the application of construction material thereto, wherein a midpoint of said beam is positioned a first distance from an upper surface of the slab, and said distal end is positioned a second distance from the upper surface of the slab, and wherein said second distance is greater than said first distance, a cable attached to said distal end of each beam, said cable being positioned in said aperture of each distal end of each beam, a net attached to and suspended from said cable, said net having an inner surface configured to be spaced from the edge of the slab, and wherein said plurality of brackets include at least one terminal bracket, comprising:

a support beam having a proximal end adapted to be secured to the slab and a distal end with an aperture, a cross beam having a proximal end adapted to be secured to the slab and a second end interconnected in a perpendicular orientation to said support beam and between said proximal end and said distal end of said support beam, said cross beam having a first lateral edge and a second lateral edge, and wherein said support beam is interconnected to said cross beam adjacent to said second lateral edge thereof, a stabilizing beam having a first end interconnected to said cross beam adjacent to said first lateral edge, and a second end interconnected to said support beam adjacent to said distal end thereof, and wherein said apertures of said support beams are configured to receive said cable, and wherein said support beam is spaced from the end of the slab when said support beam and cross beam are interconnected to the slab.

2. The netting system of claim 1, wherein said plurality of brackets include at least one corner bracket adjacent to said at least one terminal bracket, said at least one corner bracket extending further from the edge than said at least one terminal bracket.

3. The netting system of claim 2, wherein one or more add-on brackets are disposed between said at least one terminal bracket and said at least one corner bracket.

4. The netting system of claim 1, including a second array of a plurality of spaced brackets configured to be attached to a second slab and extending away from an edge of the second slab, wherein a second cable is attached cohesively to each distal end of said beams of said second array, wherein said net is attached to said second cable such that said net is configured to encase a space between first slab and the second slab.

5. The netting system of claim 4, wherein said net is spaced apart from the edge of the second slab.

6. The netting system of claim 1, wherein each of said brackets extends from said edge of said slab no more than 18 inches.

7. A netting system, comprising:

a first array of spaced brackets, each of said brackets being rigid and comprising:

a beam having a proximal end adapted to be secured to a top surface of a first slab, and a distal end having an aperture, an L-bracket having a proximal end adapted to be secured to the top surface of the first slab, and a distal end interconnected to said beam between said proximal end and said distal end of said beam, wherein when said beam and said L-bracket are secured to the top surface of the slab, said distal end of said beam is positioned away from an edge of the first slab, such that the edge is accessible to permit the application of construction material thereto, wherein a midpoint of said beam is positioned a first distance from an upper surface of the first slab, and said distal end is positioned a second distance from the upper surface of the first slab, and wherein said second distance is greater than said first distance, a first cable cohesively attached to each distal end of said beams of said first array;

a second array of said brackets configured to be secured only on a top surface of a second slab and spaced along an edge of the second slab, such that the edge the second slab is accessible to permit the application of construction material thereto, a second cable cohesively attached to each distal end of said beams of said second array, a net attached to each of said first and said second cables and suspended across a space between said first and said second slabs, said net having an inner surface that is spaced from the edge of the first slab and the second slab when the first array of spaced brackets and said second array of spaced brackets are interconnected thereto, and wherein each of said first and second array of brackets includes at least one terminal bracket, comprising:

a support beam having a proximal end adapted to be secured to the first slab and a distal end, a cross beam having a proximal end adapted to be secured to the first slab and a second end interconnected in a perpendicular orientation to said support beam and between said proximal end and said distal end of said support beam, said cross beam having a first lateral edge and a second lateral edge, and wherein said support beam is interconnected to said cross beam adjacent to said second lateral edge thereof, a stabilizing beam having a first end interconnected to said cross beam adjacent to said first lateral edge, and a second end interconnected to said support beam adjacent to said distal end thereof, and wherein said support beam is spaced from the end of the first slab when said support beam and cross beam are interconnected to the first slab.

8. The netting system of claim 7, wherein each of said first and second array of brackets includes at least one corner bracket adjacent to said at least one terminal bracket, said at least one corner bracket extending further from the edges of the first slab and the second slab than said at least one terminal bracket.

9. The netting system of claim 8, wherein one or more add-on brackets are disposed between said at least one terminal bracket and said at least one corner bracket.

10. The netting system of claim 7, wherein each of said brackets extends from said edge of said slabs no more than 18 inches.

* * * * *